US006820972B2

(12) United States Patent
Kinalski

(10) Patent No.: US 6,820,972 B2
(45) Date of Patent: Nov. 23, 2004

(54) PRINTING CARTRIDGE PIGMENT REPLENISHMENT APPARATUS AND METHOD

(75) Inventor: Michael Kinalski, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/109,927

(22) Filed: Mar. 29, 2002

(65) Prior Publication Data

US 2003/0184624 A1 Oct. 2, 2003

(51) Int. Cl.[7] ..... B41J 2/175; B41J 29/393
(52) U.S. Cl. ..... 347/85; 347/19
(58) Field of Search ..... 347/19, 85, 7, 347/84; 141/5, 2, 18, 275

(56) References Cited

U.S. PATENT DOCUMENTS 5,337,794 A * 8/1994 Nishiyama et al. ..... 141/144
5,685,348 A * 11/1997 Wegman et al. ..... 141/2
6,164,760 A * 12/2000 Mizoguchi et al. ..... 347/55
6,206,511 B1 * 3/2001 Cook et al. ..... 347/85
2002/0105565 A1 * 8/2002 Suda et al. ..... 347/85

* cited by examiner

*Primary Examiner*—Anh T. N. Vo

(57) ABSTRACT

An apparatus and method for refilling pigment cartridges. The apparatus includes a device for engaging a pigment cartridge and a pigment reservoir. A pigment transfer device, having an enabling input, is coupled to convey pigment from the pigment reservoir to the device for engaging a pigment cartridge upon activation of the enabling input. The apparatus also includes an accounting device coupled to the enabling input, such that the accounting device activates the enabling input upon receiving an account stimulus, and, thereby effects a transfer of pigment from the pigment reservoir to the pigment cartridge. In illustrative embodiments the pigment is toner or ink for laser printers and inkjet printer respectively. The accounting stimulus may be approval for a credit card transaction, a cost accounting systems, or may be cash payment.

23 Claims, 2 Drawing Sheets

PRINTING CARTRIDGE PIGMENT REPLENISHMENT APPARATUS AND METHOD

BACKGROUND OF THE INVENTION

1. Field of the Invention

The present invention relates to printing. More specifically, the present invention relates to systems and methods for maintenance of printing equipment.

2. Description of the Related Art

Printing systems are widely deployed in businesses, offices, and homes today. The predominant engine technologies used are laser and inkjet. Printers are frequently used as dedicated machines that receive data files and produce printed output according to the data file received. Laser and inkjet print engines are also deployed in facsimile machines, photocopying machines, multi-functional peripheral devices, label printers, postage machines and other machines that print output on various media types.

Both laser systems and inkjet printing systems use a pigment to create images and text on media. In a laser printer the pigment is provided as toner. In an inkjet printer, the pigment is provided as ink. Generally, the pigment is stored in a reservoir or cartridge. When the pigment is consumed, the cartridge must be replaced.

While replacing empty cartridges with full cartridges seems to be a logical approach to maintaining a reserve of pigment in a printing system, it carries a number of disadvantages. From the perspective of the user/consumer, the empty cartridge is either thrown away or recycled in some fashion. A replacement cartridge must be available in order to replenish the pigment supply in the printing system. This implies that an inventory of full cartridges must be available within ready access. Inventories of reserve cartridges carry an associated cost. When pigment is needed, the user must not only purchase the needed pigment, but also the cartridge within which it is stored. This adds significantly to the cost of adding pigment.

From the perspective of the system supplier, this conventional approach to distributing pigment has certain disadvantages. The use of disposable cartridges is environmentally unfriendly and is thus undesirable from a 'corporate citizenship' perspective. Inasmuch as the use of disposable cartridges adds to cost, the industry has addressed this issue to some extent through third party cartridge recycling companies. These companies gather empty cartridges from users, replenish the pigment supply, and sell the refilled cartridges back to users.

Unfortunately, this erodes market share from the printing systems suppliers. Further, even though third party refilled cartridges are available to users, this does nothing to reduce the need on the part of the users to maintain inventories of spare cartridges. And an inventory of cartridges must be maintained in accordance with a management scheme that provides for sufficient lead time to ensure that cartridges are available without allocating an inordinate amount of money and storage space to the requirement.

Inventory management thus involves tracking consumption and issuance of purchase requisitions and purchase orders. The management scheme must take into account some lead-time delay until cartridges are actually received into inventory. This requires some system for inventory and financial accounting. The process is particularly burdensome to small businesses where it is imperative to keep inventory costs at a minimum.

Thus, there is a need in the art for an improved apparatus and method for distributing pigment to users of printing systems.

SUMMARY OF THE INVENTION

The need in the art is addressed by the apparatus and methods of the present invention. A pigment cartridge filling apparatus is taught. The apparatus includes a removable print cartridge for storing pigment and dispensing pigment in a printing apparatus and a mechanism for transferring pigment from a reservoir to the cartridge automatically.

In a specific illustrative embodiment, the apparatus also includes an accounting device coupled to the enabling input, such that the accounting device activates the enabling input and thereby effects a transfer of pigment from the pigment reservoir to the pigment cartridge upon receipt of payment therefor.

In a more specific embodiment of the present invention, the device for engaging a pigment cartridge is keyed to accept a predetermined type of pigment cartridge. The predetermined type of pigment cartridge may be keyed based upon the color of pigment therein or based upon the type of printing device into which the cartridge is inserted.

In another refinement, the pigment reservoir includes a level sensor with an output indicative of the present level of reserve pigment in the pigment reservoir. Additionally, the inventive apparatus may include a device for communicating the present level of reserve pigment to a remote location for alerting of the need to replenish the pigment supply in the pigment reservoir. The communications may be enabled through the Internet or a local area network. In another refinement, the pigment cartridge has an electronic memory and a memory interface that operates to output usage data from the memory. The device for engaging a pigment cartridge further includes a data input positioned to engage the memory interface that operates to receive usage data therefrom.

DESCRIPTION OF THE INVENTION

Figure 1:
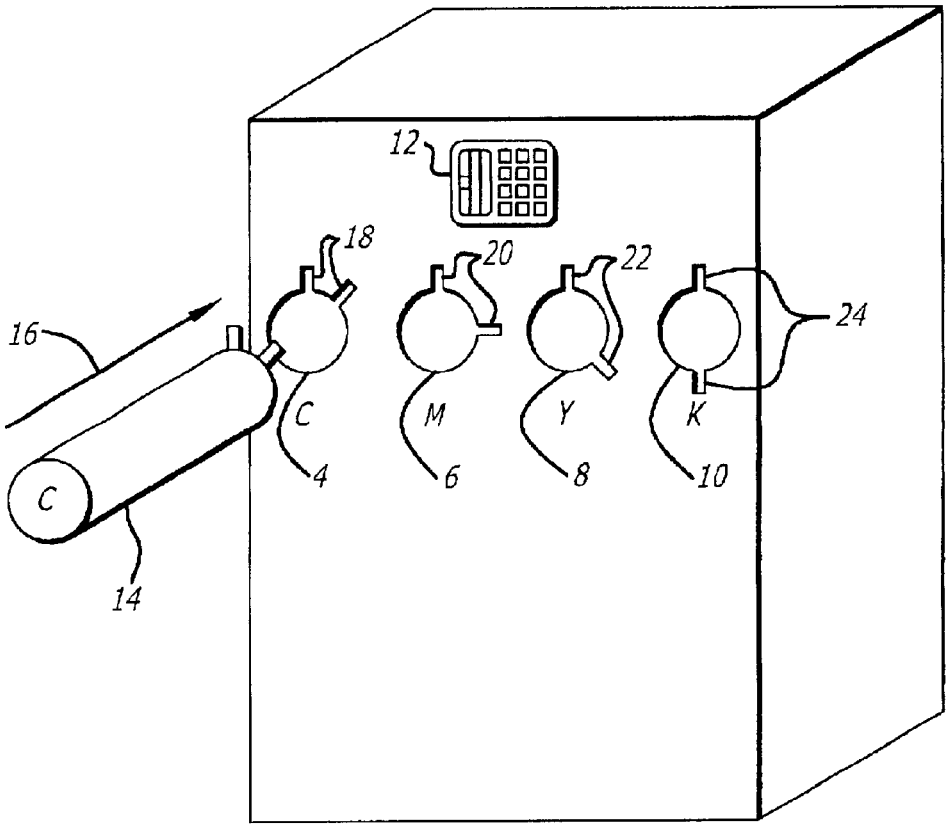
FIG. 1 is a diagram of a toner-dispensing reservoir apparatus according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Previously, toner has been dispensed within toner cartridges delivered to users through conventional commercial distribution networks. At the time a user receives a low-toner indication from their printing device, they remove the toner cartridge and shake it to dislodge packed toner and then reinsert for further use. Ultimately, the toner will become fully depleted and the user must remove the cartridge from the printer and replace it with a full cartridge. The empty cartridges are frequently thrown away. Sometimes the cartridge is recycled as other discarded materials. Sometimes the cartridge is recycled to third party suppliers that refill and resell the cartridge to another user. In addition to purchasing the replacement toner, the user is also purchasing a new or recycled cartridge, as well as the service cost for refilling it.

A user who requires a new or replacement toner cartridge must get it through some source of supply. For individuals, this may be through an office supply store or they may maintain a personal inventory of spare full cartridges. Larger businesses often have an inventory of full cartridges that are purchased and maintained by a purchasing organization within the company. As full cartridges are removed from inventory, they are accounted for by charging a cost center or cost code accordingly. Maintenance of an inventory typically includes a purchase requisition, approval, purchase order, shipping delay, delivery and payment sequence of events as are understood by those skilled in the art.

Toner cartridges are designed with a variety of configurations to suit particular printer models and makes. Color printers typically use plural toner cartridges, one for black and one or more to carry the cyan, magenta, and yellow primary colors. Each cartridge has a sufficient volume of toner for a limited number of pages.

According to the teachings of the present invention, users reuse empty toner cartridges by having them refilled. Each printer is originally supplied with one or more full toner cartridges, which are refilled from time to time as the toner reserves therein are depleted through printing operations. The refilling operation is accomplished with a novel apparatus called a toner dispensing reservoir ("TDR"). The TDR is analogous to a gasoline service station and can be thought of as a toner gas station. In operation, the empty cartridge is removed from its printer and inserted into the TDR. Within the TDR, toner is transferred from a toner reservoir into the empty cartridge to fill it. The user removes the refilled cartridge from the TDR and re-inserts it into their printer. Thus, the same cartridge is used again and again by refilling it. The TDR can be placed at convenient locations so users have ready access to toner when needed.

The TDR can be located on-site at large companies where there are relatively high toner consumption levels. In office parks where plural companies share access, the TDR is configured like a vending machine so that the unrelated users can access a single TDR. The TDR vending machine can also be located at retail outlets for convenient access by users.

To keep track of the costs associated with the TDR, in accordance with present teachings, in a large business scenario, a user with enter a cost center or accounting code that would be validated by the TDR prior to dispensing toner. Also, a badge system can be employed in which a user would swipe a magnetic striped badge through the TDR to validate that user's cost center code. Alternatively, each cartridge can be assigned to a cost center with the charging apparatus based on cartridge identity, and not just employee identity. In other scenarios, a credit or debit card transaction can be utilized to account for costs, and even cash and currency can be inserted to cover the cost of the toner.

In the illustrative embodiment, the TDR includes one or more bulk toner reservoirs in the form of bulk toner containers, such as large bins. The bins of toner are available in a variety of sizes, perhaps enough to fill hundreds of toner cartridges. The TDR is refilled from time to time by a supplier of bulk toner. The supplier monitors the toner level remotely through a communications link, such as an Internet connection. Multiple toner reservoir bins are required in a single TDR because the TDR supplies black toner as well as the primary magenta, cyan, and yellow toners.

For the convenience of the user, the TDR and the cartridges employ simple color coding schemes to make identification easy. The user simply inserts the matching color cartridge into the corresponding slot in the TDR. The slot supports and engages the cartridge to facilitate the transfer of toner. In addition, the cartridge slots in the TDR are keyed to prevent improper insertion of a toner cartridge. In an illustrative embodiment, each cartridge includes an electronic memory chip that uniquely identifies each cartridge and also has certain usage information stored therein. Usage information, or usage data, might include the type of printer the cartridge is from, what kind of toner it takes, when it was last filled and how many pages were printed. This information is transferred to the TDR during the refilling operation. The data is then conveyed to the supplier for a variety of statistical purposes, including the establishment of usage trends and so forth.

When a cartridge is inserted into the TDR, a mechanical gate opens a fill port in the cartridge and the TDR uses electrostatic, pneumatic, or other forces to transfer the toner into the cartridge. Those skilled in the art of moving toner are familiar with toner transfer technologies. In the TDR, the toner is metered into the cartridge and the cost factor is based on the actual amount of toner that is transferred. Thus, there is no penalty for refilling a partially empty toner cartridge. The accounting is done automatically.

The present invention results in a number of benefits to the user, the supplier, as well as society in general. The user benefits through lower printing costs (no cost for cartridge itself, bulk rates for toner), lower administrative costs for reordering, purchasing, inventory and so forth, and no recycling or disposal costs or liabilities. The elimination of cartridges is environmentally friendly. The user enjoys centralized toner cost tracking at the TDR. The supplier benefits because the toner-replenishment market is no longer diluted by third party cartridge refillers. Also, there might be increased revenue from printer sales and lower toner replenishment costs due to reduced packaging, bulk rate toner purchasing and the elimination of mandatory recycling costs.

Reference is directed to FIG. 1, which is a diagram of a toner-dispensing reservoir ("TDR") 2 apparatus according to an illustrative embodiment of the present invention. The TDR 2 includes four cartridge slots 4, 6, 8, 10 for the cyan, magenta, yellow and black toner cartridges respectively. Each slot engages its respective toner cartridge. Those skilled in the art will appreciate that a variety of physical and mechanical configurations can be employed to engage and align a toner cartridge with the TDR. In the illustrative embodiment, a slot 4 is formed in the TDR 2 that conforms to the shape of the toner cartridge 14. The toner cartridge 14 is inserted into the slot 4. This allows the TDR 2 to support the cartridge 14 while the toner transfer operation is accomplished.

Also, while the cartridge is supported, a filling opening in the cartridge is aligned with a toner output opening in the TDR. In FIG. 1, the cyan toner cartridge 14 is shown, as it is inserted 16 into slot 4. A pair of key slots 18 and the respective tabs on cartridge 14 align to allow the insertion the cartridge 14 into the slot 4. The other slots 6, 8, and 10 also have key slots 20, 22, and 24, each having a unique physical index arrangement. The slots are positioned so that the cartridges will not fit into the wrong slot. The TDR also includes a user interface entry panel 12.

The user interface entry panel is configured in one of a variety of ways, depending on the kind of cost accounting that is employed in the particular TDR. In the case of a debit card or credit card transaction, the user interface 12 includes a magnetic card reader to allow the user to swipe their card and have their debit/credit data read therefrom. A keypad is also included to facilitate user options selection. Debit and credit card user interface systems and designs are understood by those skilled in the art.

In the case of a cost accounting system user interface, the user interface 12 may include a keypad entry system for entering a cost accounting code or the system may use employee identification cards with encoded employee data. In the case of magnetically encoded employee identification cards, the user interface 12 would include a magnetic card reader. If a cash option were employed for payment, a coin and/or currency receiver would be included in the user interface 12. Coin and currency receivers are known to those skilled in the art.

Figure 2:
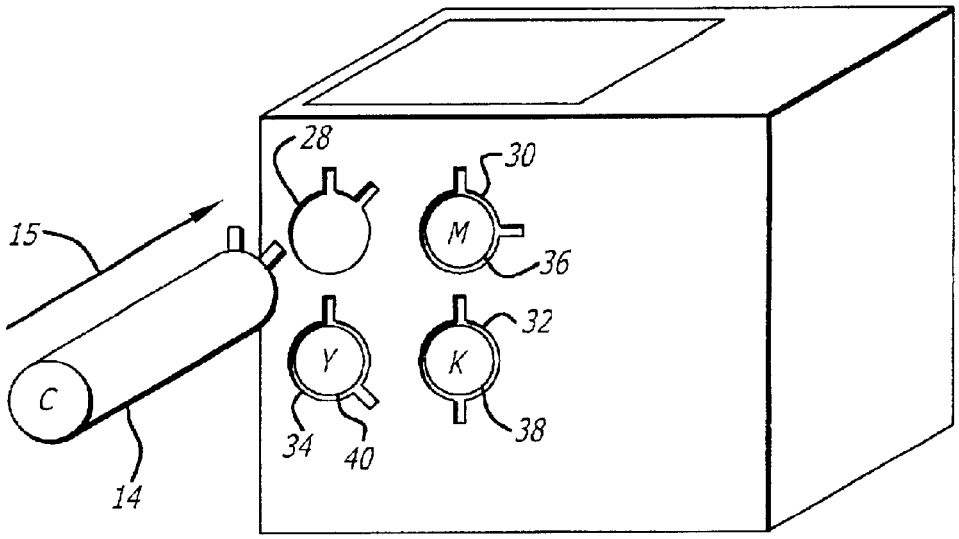
FIG. 2 is a diagram of a laser printer that accepts refillable toner cartridges according to an illustrative embodiment of the present invention.

FIG. 2 is a diagram of a laser printer 26 that accepts refillable toner cartridges according to an illustrative embodiment of the present invention. The printer 26 in the illustrative embodiment is a color laser printer and therefore has four different color toner cartridges. These include a cyan cartridge 14, a magenta cartridge 36, a yellow cartridge 40, and a black cartridge 38. Each cartridge engages the printer in a corresponding slot; slot 28 for cyan, slot 30 for magenta, slot 34 for yellow, and slot 32 for black. Each slot has one or more key tabs that prevent an erroneous insertion of a toner cartridge into a particular slot. The key tab arrangement is the same as that described with respect to FIG. 1. When the filled cartridge 14 is inserted into the printer 26, a mechanism opens the toner fill aperture in the cartridge and allows the printer to transfer toner out of the printer as required. The application of interlocked toner access openings and toner transfer techniques are known to those skilled in the art.

In an illustrative embodiment the toner cartridges include a memory chip and an electrical interface. When the cartridge is engaged into the printer, a mating electrical interface in the printer couples the memory chip in the cartridge to a controller in the printer. The printer is thus enabled to read and write to and from the memory chip in the cartridge. Through this mechanism, the cartridge can be programmed with a unique identification, a designation of the printer that it belongs to, and other usage data. For example, the printer can store the number of pages printed with the toner in the cartridge. Also, the pertinent dates as to when the cartridge has been filled emptied and serviced. When the cartridge is later inserted into the TDR, the TDR reads the memory chip and can use the usage data for statistical and other purposes. In the case where the TDR is interfaced to a network, such as the Internet, the usage data can be communicated to the supplier of the TDR for further analysis.

Figure 3:
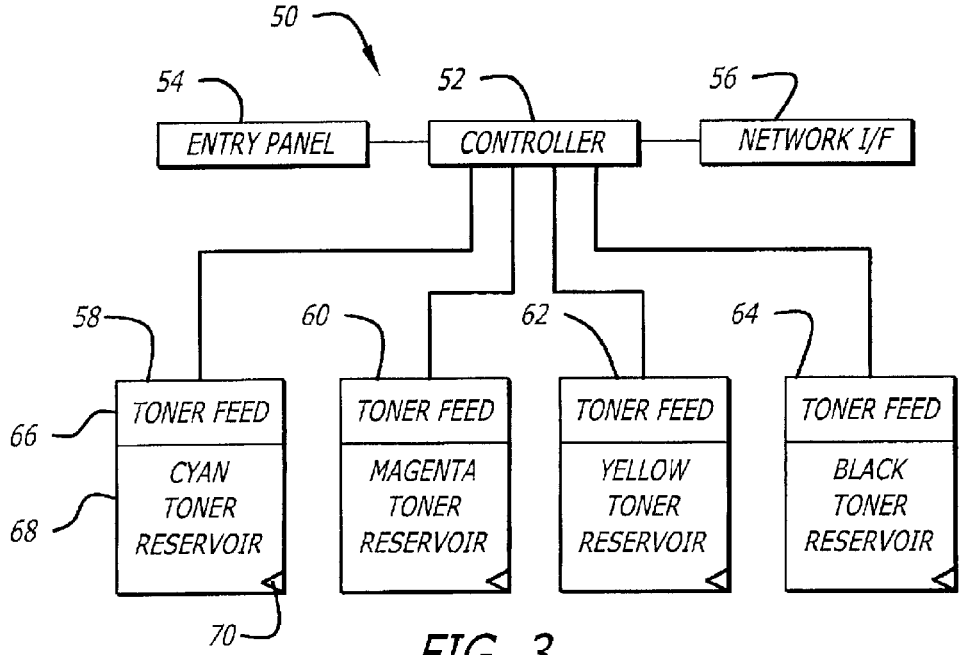
FIG. 3 is a functional block diagram of a toner-dispensing reservoir apparatus according to an illustrative embodiment of the present invention.

Reference is directed to FIG. 3, which is a functional block diagram of a toner-dispensing reservoir ("TDR") apparatus 50 according to an illustrative embodiment of the present invention. The TDR 50 is operated under control of a controller 52, which is a programmable device that executes software code that embodies the various functions of the TDR as described herein. Any type of controller known to those skilled in the art to be suitable for dedicated control applications may be used without departing from the scope of the present teachings. The user interface entry panel 54 is coupled to the controller 52. The entry panel 54 may be any of the types described above, including a debit/credit card transaction panel, an accounting code cost center interface, or a coin/currency receiver interface. Each of these kinds of user interface entry panels is known to those skilled in the art. The selection of which type of entry panel employed in any given TDR would be dependent upon the application and location of the TDR.

The controller 52 is coupled to four toner feed systems that transfer toner into the four different toner cartridges that the TDR 50 is adapted to fill. In the illustrative embodiment, these include the cyan feed system 58, the magenta feed system 60, the yellow feed system 62, and the black feed system 64. Each of the feed systems includes a feed mechanism and a toner reservoir. By way of example, the cyan feed system 58 is comprised of a cyan toner feed mechanism 66 and a cyan toner reservoir 68. Each feed mechanism engages its corresponding toner cartridge, including the physical support of the cartridge, the mechanism to open the toner feed opening in the cartridge, and the electrical interface to the memory chip in the cartridge. The feed mechanism includes a toner metering system that enables the controller 52 to determine how much toner is transferred into each toner cartridge. One way to meter the toner is to weigh the toner cartridge before and after the filling operation. Those skilled in the art will appreciate that a variety of mass and volumetric metering systems appropriate to the metering of solids and liquids that can be readily employed to meter the toner or pigment transferred.

Each the toner reservoirs, and toner reservoir 68 by way of specific example, includes a level sensing device 70. The level sensing device is used to determine the amount of toner remaining in the reservoir 68. When the amount of toner falls below a predetermined level, the controller 52 outputs an alert to notify the supplier that the reservoir needs to be replenished. In the illustrative embodiment, the toner reservoirs are large sealed containers that hold enough toner to fill a large number of toner cartridges. The toner reservoirs are inserted into the TDR 50 by a service technician and are replaced from time to time, depending on the rate to toner consumption.

The controller 52 is coupled to a network interface 56. In the illustrative embodiment, the network interface 56 is an Internet interface and the TDR 50 is assigned an Internet address. Although, a local area network interface can be employed in private corporate applications, and other interfaces known to those skilled in the art can also be employed as needed. The network interface 56 allows the supplier of toner to monitor the TDR remotely. The network interface also provides for the ATM network interface required to approve and clear credit and debit card transactions. Similarly, in the case of a cost center accounting systems, the network interface 56 allows interface to the using companies accounting system computers.

Figure 4:
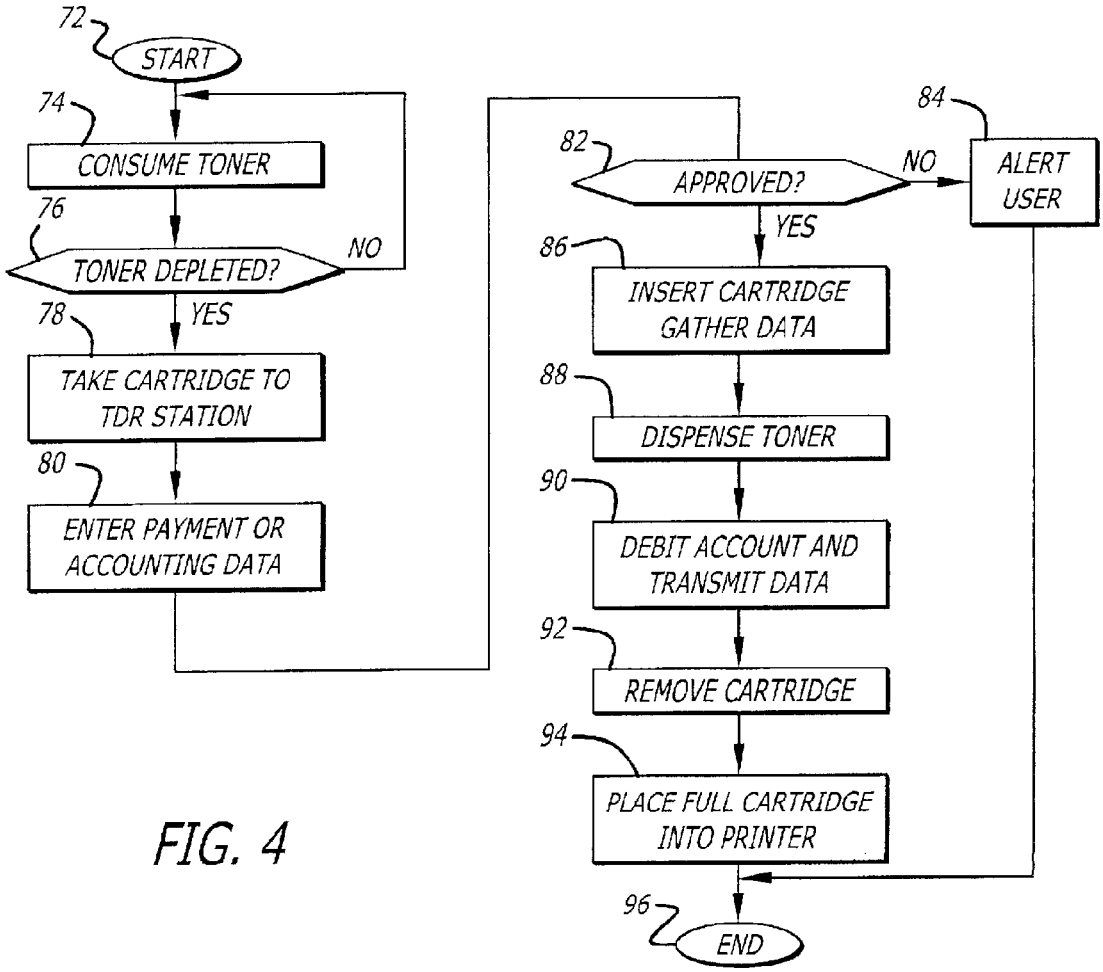
FIG. 4 is a flow diagram of the toner consumption-replenishment process according to an illustrative embodiment of the present invention.

Reference is directed to FIG. 4, which is a flow diagram of the toner consumption-replenishment process according to an illustrative embodiment of the present invention. The process begins at step 72 and proceeds to step 74 where toner is consumed through printing operations. At step 76 at test is made to determine if the toner has been depleted. This test can be accomplished with an automatic level sensor, visual inspection or the failure of the printing device to continue printing. If the toner is not yet depleted at step 76, flow returns to step 74 for further printing. On the other hand, at step 76, if the toner is depleted, flow proceeds to step 78. At step 78, the user removes the toner cartridge from the printing device and takes it to a TDR station for replenishment. In the case of a corporate environment, the TDR may be as close as the nearest supply room. In the case of an office park environment, the TDR may be at a central location in the park. For the small office or home office user, the TDR may be at the local office supply store.

At step 80, the user enters payment or account information into the TDR user interface panel. Illustrative forms of payment and accounting have been described above. At step 82, as test is made to determine if the payment method has been approved. In the case of a debit/credit card transaction, the receipt of an approval through and ATM authorization network accomplishes this step. In the corporate cost center code environment, the approval is received from a corporate accounting computer system. In the case of a cash payment, the approval is received when the required amount of coin or currency has been inserted into the TDR by the user. In any case, if the approval is not received at step 82, the user is alerted at step 84 and the process terminates at step 96. On the other hand, if payment is approved at step 82, flow continues to step 86 where the user is instructed to insert the cartridge into the TDR if the user has not already done this.

At step 88, the TDR transfers toner from its internal reservoir to the toner cartridge. The process continues until the cartridge is filled. Various methods of handing and transferring toner into a toner cartridge are known to those skilled in the art. At step 90, the TDR debits the user's account for the value of the toner transferred. It should be noted that in the case of a cash payment, the supplier might use a fixed cost regardless of the amount of toner transferred. Alternatively, the supplier may refund a portion of the payment entered in the case where a lesser amount of toner is dispensed than was initially paid for. Also at step 90, the TDR transmits usage data for the toner cartridge filled through its network connection.

At step 92 the user removes the filled toner cartridge from the TDR. At step 94 the user inserts the toner cartridge into the printer, and the process ends at step 96.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A pigment cartridge filling apparatus, comprising:

a means for engaging a pigment cartridge;

a pigment reservoir;

a transfer means, having an enabling input, coupled to convey said pigment from said pigment reservoir to said means for engaging a pigment cartridge upon activation of said enabling input; and an accounting means coupled to said enabling input, wherein said accounting means activates said enabling input upon receipt of an account stimulus and thereby effects a transfer of said pigment from said pigment reservoir to the pigment cartridge.

2. The apparatus of claim 1 wherein said means for engaging a pigment cartridge is keyed to accept a specific type of pigment cartridge.

3. The apparatus of claim 2 wherein said predetermined type of pigment cartridge is keyed based upon the color of pigment therein, or is keyed based upon the type of printing device into which the cartridge is inserted.

4. The apparatus of claim 1 wherein said pigment reservoir has a level sensor with an output indicative of the present level of reserve pigment in said pigment reservoir.

5. The apparatus of claim 4 further comprising a means for communicating cartridge usage data via a network.

6. The apparatus of claim 5 wherein said means for communicating is the Internet or a local area network.

7. The apparatus of claim 1 wherein the pigment cartridge has an electronic memory and a memory interface operable to output usage data from the memory, and wherein said means for engaging a pigment cartridge further comprises a data input positioned to engage the memory interface and is operable to receive usage data therefrom.

8. The apparatus of claim 7 further comprising a means for communicating said usage data via the Internet or a local area network.

9. The apparatus of claim 1 wherein the pigment is toner or ink.

10. The apparatus of claim 1 wherein said payment data is an approved debit or credit card transaction, an approved internal account code, or the receipt of cash or coin payment.

11. A method of filling pigment cartridges in a system having a pigment reservoir, a means for engaging a pigment cartridge, and an accounting means, comprising the steps of:

engaging a pigment cartridge with the means for engaging a pigment cartridge;

producing an account stimulus to the accounting means; and conveying pigment from the reservoir to the pigment cartridge in response to said payment data.

12. The method of claim 11 wherein the means for engaging a pigment cartridge is keyed to accept a specific type of pigment cartridge.

13. The method of claim 12 wherein said predetermined type of pigment cartridge is keyed based upon the color of pigment therein, or is keyed based upon the type of printing device into which the cartridge is inserted.

14. The method of claim 11 further comprising the steps of:

detecting the level of reserve pigment in the pigment reservoir and outputting said level of reserve pigment in the pigment reservoir.

15. The method of claim 14 further comprising the step of communicating cartridge usage data via a network.

16. The method of claim 15 wherein said communicating step is accomplished through the Internet or a local area network.

17. The method of claim 15 further comprising the step of replenishing the pigment in the pigment reservoir in response to the receipt of said usage data.

18. The method of claim 11 further including the step of transferring the usage data out of the memory.

19. The method of claim 18 further comprising the step of communicating said usage data via a network.

20. The method of claim 11 wherein the pigment is toner or ink.

21. The method of claim 11 wherein said producing step comprises the steps of:

entering debit of credit card transaction information and approving said transaction to produce said payment data.

22. The method of claim 11 wherein said producing step comprises the steps of:

entering an internal accounting code and approving said accounting code to produce said payment data.

23. The method of claim 11 wherein said payment data is cash or coin payment.

* * * * *

UNITED STATES PATENT AND TRADEMARK OFFICE

CERTIFICATE OF CORRECTION

PATENT NO. : 6,820,972 B2
DATED : November 23, 2004
INVENTOR(S) : Kinalski

It is certified that error appears in the above-identified patent and that said Letters Patent is hereby corrected as shown below:

Column 8,
Line 40, delete “an account stimulus” and insert therefor -- payment data --.
Line 44, delete “specific” and insert therefor -- predetermined --.
Line 52, delete “the” and insert therefor -- a --.
Line 56, delete “means for” and insert therefor -- network --.
Line 57, delete “communicating”.

Column 9,
Line 12, delete “producing an account stimulus” and insert therefor -- providing payment data --.
Line 17, delete “specific” and insert therefor -- predetermined --.

Column 10,
Line 11, delete “the usage data out of the memory.” and insert therefor -- usage data into out of a memory. --

Signed and Sealed this

Twenty-eighth Day of June, 2005

JON W. DUDAS
*Director of the United States Patent and Trademark Office*